US005957711A

United States Patent [19]

Tanaka et al.

[11] Patent Number: 5,957,711

[45] Date of Patent: Sep. 28, 1999

[54] INTER-RELATIVE ROTATING MEMBER RELAYING DEVICE

[75] Inventors: Hiraku Tanaka; Satoshi Ishikawa; Katsu Yasui, all of Shizuoka-ken, Japan

[73] Assignee: Yazaki Corporation, Tokyo, Japan

[21] Appl. No.: 08/867,461

[22] Filed: Jun. 2, 1997

[30] Foreign Application Priority Data

Jun. 6, 1996 [JP] Japan ..... 8-144596

[51] Int. Cl.[6] ..... H01R 35/04

[52] U.S. Cl. ..... 439/164; 439/15

[58] Field of Search ..... 439/164, 15

[56] References Cited

U.S. PATENT DOCUMENTS 5,256,075 10/1993 Miyahara et al. ..... 439/164

5,529,505 6/1996 Kuramoto et al. ..... 439/164

*Primary Examiner*—Gary F. Paumen

*Attorney, Agent, or Firm*—Finnegan, Henderson, Farabow, Garrett, & Dunner, L.L.P.

[57] ABSTRACT

There is provided an inter-relative rotating member relaying device which includes a first rotating unit having an inside cylinder section, a second rotating unit having an outside cylinder section which encircles the inside cylinder section with a predetermined distance and makes a relative rotation with respect to the inside cylinder, a flexible flat cable accommodated along within a ring-shaped space between the inside cylinder section and the outside cylinder section and having an inner peripheral end section held by the inside cylinder section and an outer peripheral end section held by the outside cylinder section, and a mobile unit provided movably along the space and for inverting the flexible flat cable at an opening section, wherein the first rotating unit has on its upper surface a flange for movably mounting the mobile unit on the flange, and the peripheral end section of the upper surface of the flange is formed at a lower level than a portion on which the mobile unit is mounted. Accordingly, it is possible to prevent a projection generated by contacts with other parts from interfering a flexible flat cable and to prevent a generation of abnormal noise.

12 Claims, 6 Drawing Sheets

INTER-RELATIVE ROTATING MEMBER RELAYING DEVICE

BACKGROUND OF THE INVENTION

The present invention relates to an inter-relative rotating member relaying device for carrying out an electrical connection between members which make relative rotations, through a cable.

Conventionally, this type of inter-relative rotating member relaying device includes a rotating unit having an inside cylinder section, a fixed unit having an outside cylinder section for surrounding the inside cylinder section with a predetermined distance, a cable accommodated in a disk-shaped space between the inside cylinder section and the outside cylinder section, along this space, with the inner peripheral end section being held by the inside cylinder section and an outer peripheral end section being held by the outside cylinder section, and a C-shaped mobile unit provided movably along the space and for inverting the cable at the opening section.

In this case, the rotating unit has a flange on which the mobile unit can be movably mounted. The upper surface of the flange is shaped plane from the inside cylinder section to the outer peripheral end, and the mobile unit is movably mounted on this upper surface.

Since the flange provided on the rotator is shaped plane to the outer peripheral end, when other part is brought into contact with the outer peripheral end of the flange at the time of formation, storage, transportation or assembling of the rotating unit, there is a case where the contacted portion is deformed and a projection which stretches above the upper surface of the flange is formed. In this case, there occurs an inconvenience that an inversion section of the cable is caught by this projection and this generates an abnormal noise.

SUMMARY OF THE INVENTION

With a view to solving the above-described problems, it is an object of the present invention to provide an inter-relative rotating member relaying device which can prevent a projection generated by contacts with other parts from interfering a flexible flat cable and can prevent a generation of abnormal noise.

In order to achieve the above-described object of the present invention, there is provided an inter-relative rotating member relaying device which includes a first rotating unit having an inside cylinder section, a second rotating unit having an outside cylinder section which encircles the inside cylinder section with a predetermined distance and makes a relative rotation with respect to the inside cylinder, a flexible flat cable accommodated along within a ring-shaped space between the inside cylinder section and the outside cylinder section and having an inner peripheral end section held by the inside cylinder section and an outer peripheral end section held by the outside cylinder section, and a mobile unit provided movably along the space and for inverting the flexible flat cable at an opening section, wherein the first rotating unit has on its upper surface a flange for movably mounting the mobile unit on the flange, and the peripheral end section of the upper surface of the flange is formed at a lower level than a portion on which the mobile unit is mounted.

According to the above-described structure, since the peripheral section of the upper surface of the flange is formed at a lower level than the portion on which the mobile unit is mounted, even if a projection which stretches above the upper surface is generated on the outer peripheral end of the flange due to a strike of an object against the outer peripheral end, it is possible to prevent the projection from stretching above the portion on which the mobile unit is mounted. Accordingly, it is possible to prevent the flexible flat cable from being interfered by the projection and generating an abnormal noise.

Further, by forming the peripheral end section of the upper surface of the flange at a level lower than the portion on which the mobile unit is mounted, it is possible to prevent securely the projection from stretching above the section on which the mobile unit is mounted.

Further, when a curved-shaped plane is formed at the corner of the upper surface of the flange from the portion on which the mobile unit is mounted toward the periphery, an occurrence of a flash at the corner can be prevented. Accordingly, it is also possible to prevent an occurrence of an abnormal noise due to an interference of the flexible flat cable by the flange.

Further, the plane at the corner section may be formed in a slope.

Further, when the peripheral end section of the upper surface of the flange is formed in a curved plane which gradually becomes lower from the portion on which the mobile unit is mounted, it is possible to prevent securely the projection from stretching above the section on which the mobile unit is mounted and it is also possible to prevent the occurrence of a flash on the peripheral end section. Accordingly, it is possible to prevent an occurrence of an abnormal noise due to an interference of the flexible flat cable by the flange.

Further, the peripheral end section of the upper surface of the flange may also be formed in a sloped plane which gradually becomes lower from the portion on which the mobile unit is mounted, in stead of the above-described curved surface of the peripheral end section.

DESCRIPTION OF THE PREFERRED EMBODIMENTS

Figure 1:
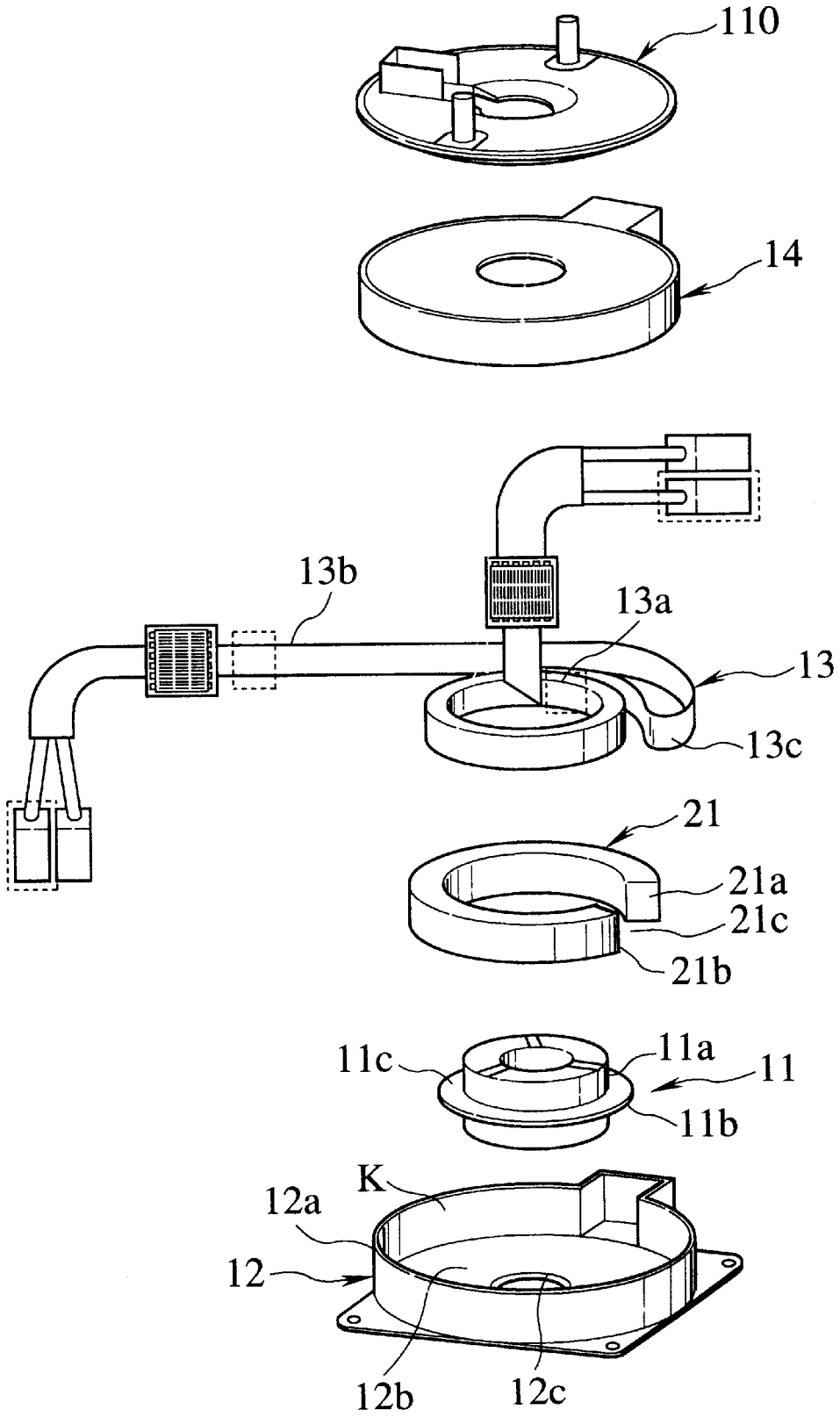
FIG. 1 is a perspective broken view of the inter-relative rotating member relaying device relating to an embodiment of the present invention.
Figure 2:
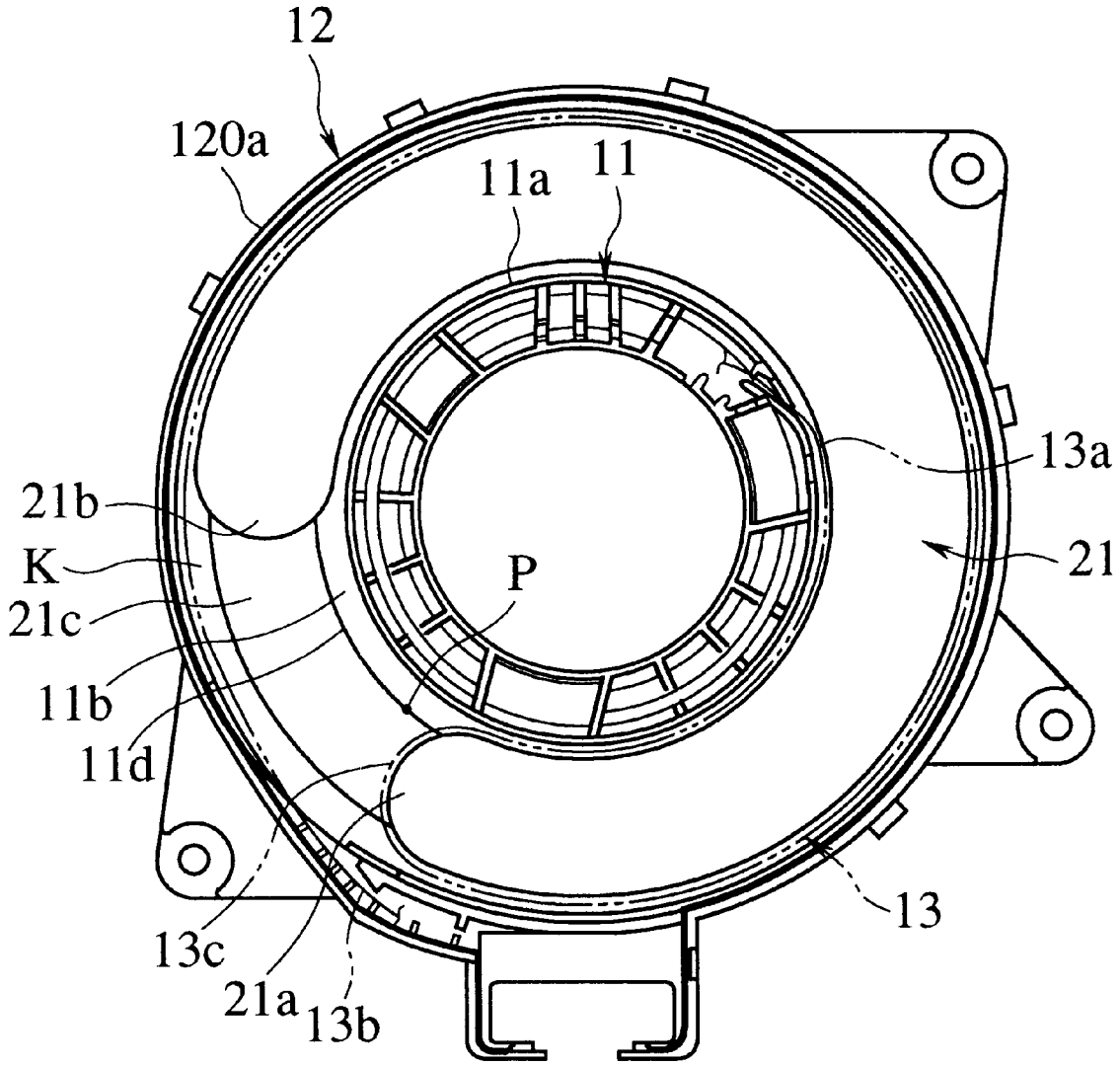
FIG. 2 is a plan view of the inter-relative rotating member relaying device shown in FIG. 1.
Figure 3:
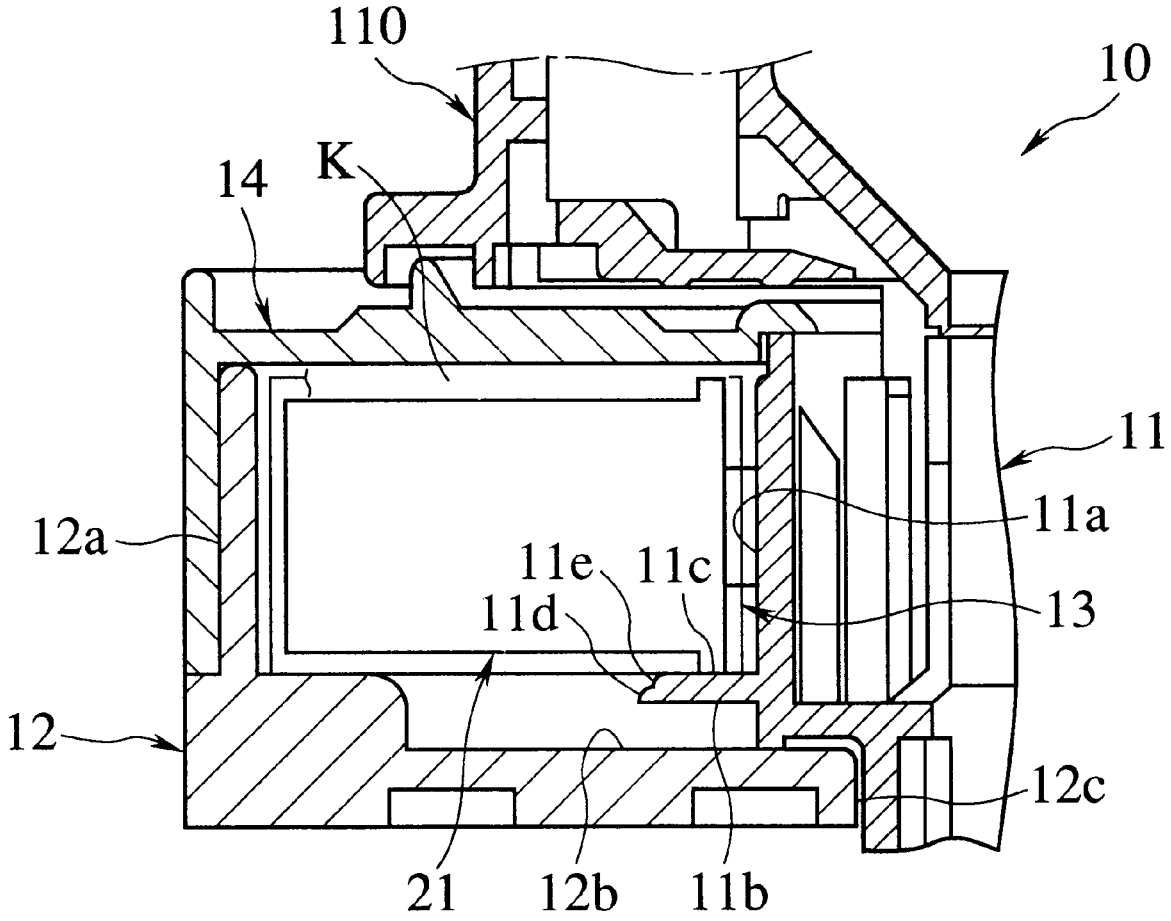
FIG. 3 is a cross-sectional view of the key elements of the inter-relative rotating member relaying device shown as a first embodiment of the present invention.
Figure 4:
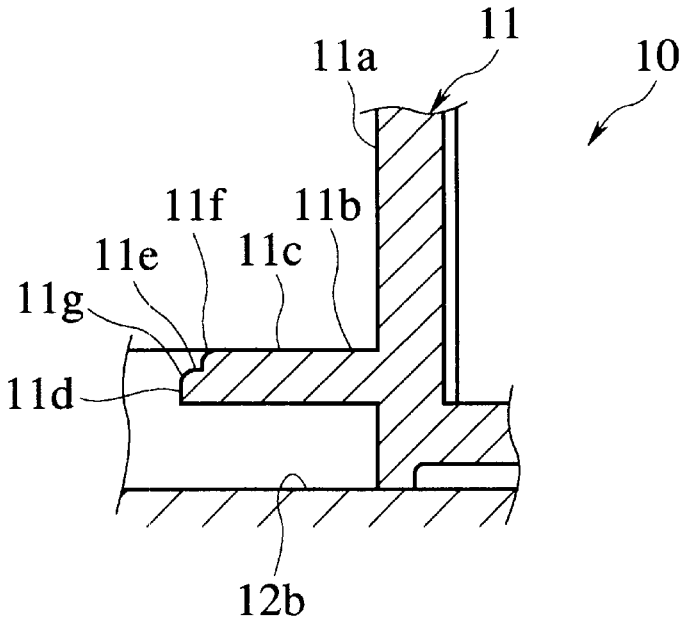
FIG. 4 is a cross-sectional view for showing the section of the flange of the rotating unit in FIG. 3.
Figure 5:
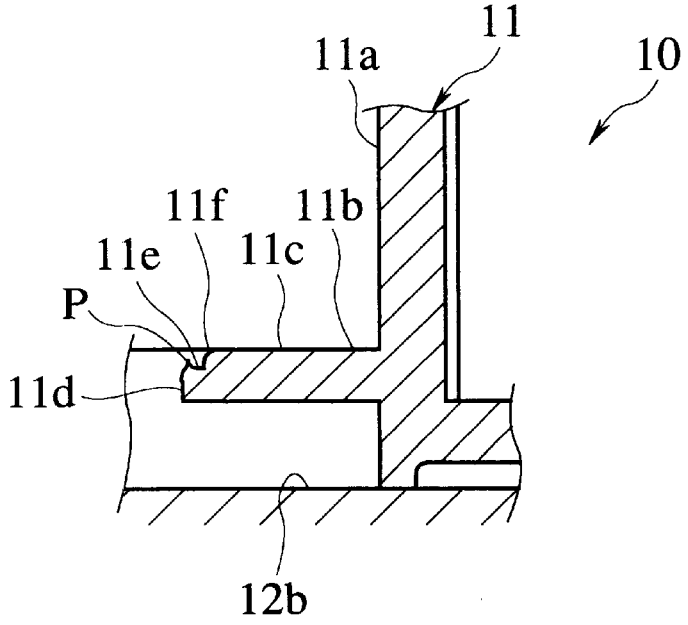
FIG. 5 is a cross-sectional view for explaining the work effect of the inter-relative rotating member relaying device shown in FIG. 1.
Figure 6:
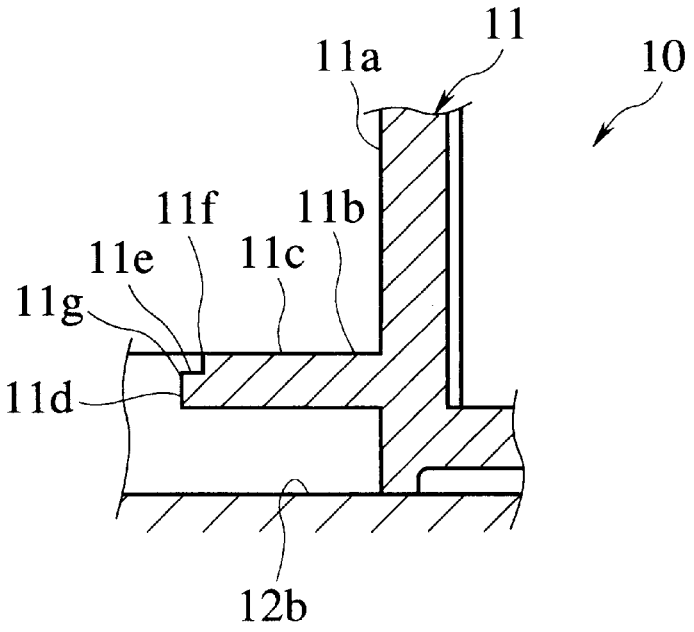
FIG. 6 is a cross-sectional view for showing the flange section of the rotating unit in the inter-relative rotating member relaying device shown as a second embodiment of the present invention.
Figure 7:
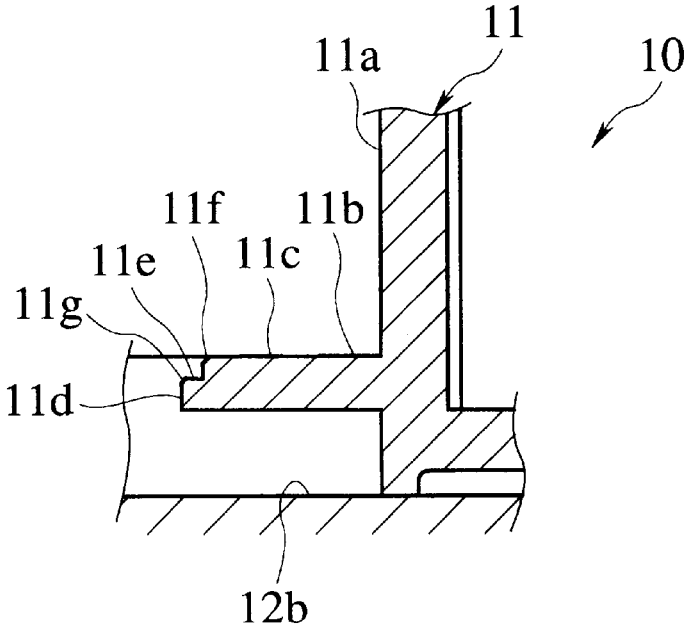
FIG. 7 is a cross-sectional view for showing the flange section of the rotating unit in the inter-relative rotating member relaying device shown as a third embodiment of the present invention.
Figure 8:
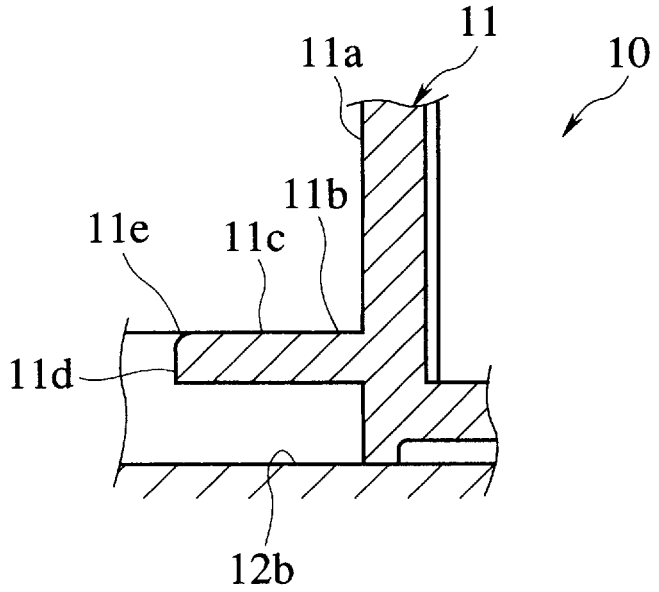
FIG. 8 is a cross-sectional view for showing the flange section of the rotating unit in the inter-relative rotating member relaying device shown as a fourth embodiment of the present invention.
Figure 9:
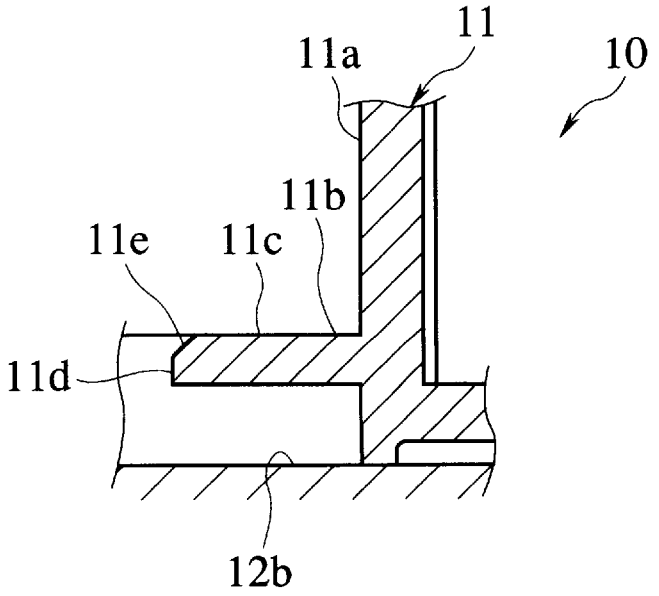
FIG. 9 is a cross-sectional view for showing the flange section of the rotating unit in the inter-relative rotating member relaying device shown as a fifth embodiment of the present invention.

Embodiments of the present invention will be explained below with reference to FIGS. 1 to 9. FIGS. 1 and 2 show the whole picture of the inter-relative rotating member relaying device common to each embodiment, FIGS. 3 to 5 show a first embodiment, FIG. 6 shows a second embodiment, FIG. 7 shows a third embodiment, FIG. 8 shows a fourth embodiment, and FIG. 9 shows a fifth embodiment.

At first, the first embodiment will be explained with reference to FIGS. 1 to 5.

As shown in FIG. 1, an inter-relative rotating member relaying device 10 includes a rotating unit (a first rotating unit) 11 having an inside cylinder section 11*a,* a fixed unit (a second rotating unit) 12 having an outside cylinder section 12*a* which encircles the inside cylinder section 11*a* with a predetermined distance, a cable (a flexible flat cable) 13 accommodated along within a ring-shaped space K between the inside cylinder section 11*a* and the outside cylinder section 12*a* and having an inner peripheral end section 13*a* held by the inside cylinder section 11*a* and an outer peripheral end section 13*b* held by the outside cylinder section 12*a*, and a C-shaped mobile unit 21 provided movably along the space K and for inverting the cable 13 at an opening section 21*c*.

The rotating unit 11 is provided with a flange 11*b*. On an upper surface 11*c* of the flange 11*b,* a mobile unit 21 is mounted movably.

A mobile unit 21 moves by rotating along the space K by smoothly inverting the cable 13 through one opening end 21*a* or other opening end 21*b* at an opening section 21*c* of the mobile unit 21, as shown in FIG. 2.

On the fixed unit 12, a lower cover 12*b* is integrally formed to cover the lower side of the space K and to rotatably support the inside cylinder section 11*a* of the rotating unit 11, as shown in FIGS. 1 and 2. On the lower cover 12*b*, a piercing hole 12*c* is formed to pierce through the lower portion of the inside cylinder section 11*a* of the rotating unit 11. Further, on the fixed unit 12, a cover member 14 is provided to cover the upper side of the space K and the surrounding of the outside cylinder section 12*a*. This cover member 14 is arranged not to make a relative rotation with respect to the fixed unit 12.

Further, on the upper side of the cover member 14, an external guide cover 110 is provided for guiding the inner peripheral end section 13*a* of the cable 13 to the outside. This external guide cover 110 integrally rotates with the rotating unit 11.

The rotating unit 11 is linked to the steering wheel side of the handle section of an automobile, for example, and the fixed unit 12 is fixed to the steering column side.

When the inside cylinder section 11*a* moves in a counter-clockwise direction in FIG. 2, for example, the cable 13 moves in a direction to be wound around the inside cylinder section 11*a*. Thus, the cable 13 outside the mobile unit 21 starts inverting by keeping in contact with one of the opening end sections, 21*a*, of the mobile unit 21, and enters the inside of the mobile unit 21 so that the cable 13 is wound around the inside cylinder section 11*a*. In this case, the other opening end 21*a* of the mobile unit 21 rotates in a counter-clockwise direction together with the inversion section 13*c* of the cable 13.

When the inside cylinder section 11*a* rotates in a clockwise direction to the outside cylinder section 12*a*, the cable 13 so far being wound around the inside cylinder section 11*a* is rewound and moves to the surrounding. Therefore, the cable so far being wound around the inside cylinder section 11*a* starts inverting by keeping in contact with the other opening end 21*b* of the mobile unit 21, moves towards the outside of the mobile unit 21 and is brought into close contact with the inner surface of the outside cylinder section 12*a*. In this case, the other opening end 21*b* of the mobile unit 21 rotates in a clockwise direction together with the inversion section 13*c* of the cable 13.

Then, the inversion section 13*c* of the cable 13 moves in a peripheral direction in a way to cross an outer peripheral end 11*d* of the flange 11*b*.

Further, as shown in FIG. 3, a peripheral end section 11*e* of the upper surface 11*c* of the flange 11*b* is formed to be lower than an upper surface 10*c* (a portion on which the mobile unit 21 is mounted).

In other words, the peripheral end section 11*e* of the flange 11*b* is formed in a plane lower than the upper surface 11*c*, as shown in FIG. 11*c*. At an angular section 11*f* which faces the peripheral end section 11*e* from the upper surface 11*c*, a curved plane such as a circle or an oblong is formed. An angular section 11*g* is also formed in a similar curved plane which is a border between the peripheral end section 11*e* and the outer peripheral end section 11*d*. The rotating unit 11 having the above-described flange 11*b* is integrally formed by a resin injection molding.

Base on the inter-relative rotating member relaying device 10 having the above-described structure, when other part is brought into contact with the outer peripheral end 11*d* of the flange 11*b* at the time of formation, storage, transportation or assembling of the rotating unit 11 and the contacted portion is deformed and a part of the outer peripheral end 11*d* generates a projection P (reference FIG. 5) which might stretch above the upper surface 11*c*, the stretching of the projection P above the upper surface 11*c* can be prevented because the peripheral end section 11*e* is formed at a level lower than the upper surface 11*c*. Accordingly, it is possible to securely prevent the cable 13 from being interfered by the projection P and generating an abnormal noise.

Further, since the angular section 11*f* is formed in a curved plane which faces the peripheral end section 11*e* from the upper surface 11*c*, an occurrence of a flash at the angular section 11*f* at the time of an injection molding can be prevented. Accordingly, it is possible to prevent a generation of an abnormal noise due to the cable 13 being interfered by a flash.

Next, a second embodiment of the present invention will be explained with reference to FIG. 6. Those elements which are common to the first embodiment will be attached with the same reference numerals and their explanation will be omitted. The second embodiment is different from the first embodiment in that the peripheral end section 11*e* is formed simply one stage lower.

In other words, the angular sections 11*f* and 11*g* are not rounded off.

In the inter-relative rotating member relaying device 10 having the above-described structure, it is also possible to prevent the above-described projection P from stretching above the upper surface 11*c*. Accordingly, it is possible to securely prevent the cable 13 from being interfered by the projection P and generating an abnormal noise.

Next, a third embodiment of the present invention will be explained with reference to FIG. 7. Those elements which are common to the first embodiment will be attached with the same reference numerals and their explanation will be omitted. The third embodiment is different from the first embodiment in that the angular sections 11*f* and 11*g* are formed in a sloped plane.

In other words, sloped planes of 45 degrees with respect to the upper surface 11*c* are formed at the angular sections 11*f* and 11*g*.

In the inter-relative rotating member relaying device 10 having the above-described structure, it is also possible to prevent the cable 13 from being interfered by the projection P and generating an abnormal noise, in the same manner as in the first embodiment.

Next, a fourth embodiment of the present invention will be explained with reference to FIG. 8. Those elements which are common to the first embodiment will be attached with the same reference numerals and their explanation will be omitted. The fourth embodiment is different from the first embodiment in that the peripheral end section 11*e* is formed in a curved plane.

In other words, the peripheral end section 11*e* is formed in a curved plane such as a circle or an oblong which becomes gradually lower toward the outer peripheral end section lid from the upper surface 11*c*.

In the inter-relative rotating member relaying device 10 having the above-described structure, it is also possible to securely prevent the above-described projection P from stretching above the upper surface 11*c*, and to prevent a generation of a flash at the angular sections. Accordingly, it is possible to prevent the cable 13 from being interfered by the projection P or a flash and generating an abnormal noise.

Next, a fifth embodiment of the present invention will be explained with reference to FIG. 9. Those elements which are common to the first embodiment will be attached with the same reference numerals and their explanation will be omitted. The fifth embodiment is different from the first embodiment in that the peripheral end section 11*e* is formed in a sloped plane.

In other words, the peripheral end section 11*e* is formed in a sloped plane which becomes gradually lower toward the outer peripheral end section 11*d* from the upper surface 11*c*. Then, the peripheral end section 11*e* is sloped by 45 degrees with respect to the upper surface 11*c*.

In the inter-relative rotating member relaying device 10 having the above-described structure, it is also possible to prevent the cable 13 from being interfered by the projection P or a flash and generating an abnormal noise, in the same manner as in the fourth embodiment.

What is claimed is:

1. A rotatable relay device, comprising:

a first rotating unit having an inside cylinder section and a flange, said flange having an upper surface and a peripheral end section, said peripheral end section susceptible to deformation;

a second rotating unit having an outside cylinder section encircling the inside cylinder section with a predetermined distance, said second rotating unit being rotatable with respect to said inside cylinder, said inside cylinder section and said outside cylinder section defining a ring-shaped space;

a flexible flat cable placed in said ring-shaped space between said inside cylinder section and said outside cylinder section, said flexible cable having an inner peripheral end section held by said inside cylinder section and an outer peripheral end section held by said outside cylinder section, said flat cable being susceptible to damage from passing over the deformation of said peripheral end section; and a mobile unit movably mounted on said upper surface of said flange in said ring-shaped space, for inverting said flexible flat cable at an opening section, wherein said peripheral end section is spaced from said upper surface to avoid damage of said flexible cable from passing over the deformation of said peripheral end section.

2. The rotatable relay device according to claim 1, wherein said peripheral end section is formed in a plane one step lower than said upper surface.

3. The rotatable relay device according to claim 1, wherein said flange has an angular section formed in a curved plane at each of said upper surface and said peripheral end section.

4. The rotatable relay device according to claim 2, wherein said flange has an angular section formed in a sloped plane at each of said upper surface and said peripheral end section.

5. The rotatable relay device according to claim 1, wherein said flange has a curved plane gradually descending from said upper surface to said peripheral end section.

6. The rotatable relay device according to claim 1, wherein said flange has a sloped plane gradually descending from said upper surface to said peripheral end section.

7. A rotatable relay device, comprising:

a flexible cable; and a rotating unit comprising:

a cylinder section having an outer surface for winding the flexible cable; and a flange extending from the cylinder section and having an upper surface and a peripheral end section, the upper surface being slidably contacted with the flexible cable and the peripheral end section being spaced from the upper surface, the flexible cable passing over the peripheral end portion.

8. The rotatable relay device according to claim 7, wherein said peripheral end section is formed in a plane one step lower than said upper surface.

9. The rotatable relay device according to claim 8, wherein said flange has an angular section formed in a curved plane at each of said upper surface and said peripheral end section.

10. The rotatable relay device according to claim 8, wherein said flange has an angular section formed in a sloped plane at each of said upper surface and said peripheral end section.

11. The rotatable relay device according to claim 7, wherein said flange has a curved plane gradually descending from said upper surface to said peripheral end section.

12. The rotatable relay device according to claim 7, wherein said flange has a sloped plane gradually descending from said upper surface to said peripheral end section.

* * * * *